US010719038B2

(12) United States Patent
Sakai

(10) Patent No.: US 10,719,038 B2
(45) Date of Patent: Jul. 21, 2020

(54) IMAGE FORMING APPARATUS ADJUSTING LIGHT EMISSION OF LIGHT-EMITTING ELEMENT

(71) Applicant: CANON KABUSHIKI KAISHA, Tokyo (JP)

(72) Inventor: Masayuki Sakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/512,053

(22) Filed: Jul. 15, 2019

(65) Prior Publication Data

US 2020/0033761 A1 Jan. 30, 2020

(30) Foreign Application Priority Data

Jul. 26, 2018 (JP) ..... 2018-140607

(51) Int. Cl.
*G03G 15/16* (2006.01)
*G03G 15/00* (2006.01)

(52) U.S. Cl.
CPC ..... *G03G 15/1605* (2013.01); *G03G 15/5054* (2013.01); *G03G 2215/00042* (2013.01)

(58) Field of Classification Search
CPC ..... G03G 2215/00042; G03G 15/5041; G03G 15/5058
See application file for complete search history.

(56) References Cited

U.S. PATENT DOCUMENTS 5,764,251 A * 6/1998 Hashimoto ..... B41J 2/01 250/559.16
2003/0044190 A1* 3/2003 Nakayama ..... G03G 15/5062 399/49
2008/0056752 A1* 3/2008 Denton ..... G03G 15/5062 399/74
2011/0044713 A1* 2/2011 Masuda ..... G03G 15/0131 399/74
2012/0051770 A1* 3/2012 Sasaki ..... G03G 15/5058 399/49

(Continued)

FOREIGN PATENT DOCUMENTS

JP 6-250480 A 9/1994
JP 2003-50493 A 2/2003

(Continued)

OTHER PUBLICATIONS

Machine translation of Masayuki, JP 2017-003689 (2017).*

*Primary Examiner* — Sevan A Aydin
(74) *Attorney, Agent, or Firm* — Canon U.S.A., Inc. IP Division

(57) ABSTRACT

An apparatus includes a photosensitive member on which an electrostatic latent image is formed, a developing unit that develops the electrostatic latent image as an image by using toner, an image bearing member to which the image is transferred, a detecting unit including a plurality of light-emitting elements that emit light toward the image bearing member and a light-receiving element that receives light reflected from a detection target, and a control unit that adjusts an image forming condition. The control unit adjusts a light-emission ratio between the light-emitting elements based on a difference between a reflected light amount at a first position on the image bearing member and a reflected light amount at a second position.

20 Claims, 7 Drawing Sheets

(56) References Cited

U.S. PATENT DOCUMENTS

| | | | | |
|---|---|---|---|---|
| 2020/0057404 | A1* | 2/2020 | Ino | G03G 15/5062 |
| 2020/0057408 | A1* | 2/2020 | Ishido | G01J 1/4223 |
| 2020/0081365 | A1* | 3/2020 | Araki | G03G 15/0131 |

FOREIGN PATENT DOCUMENTS

| | | | |
|---|---|---|---|
| JP | 2008-287183 | A | 11/2008 |
| JP | 2009-143188 | A | 7/2009 |
| JP | 2017-3689 | A | 1/2017 |

* cited by examiner

IMAGE FORMING APPARATUS ADJUSTING LIGHT EMISSION OF LIGHT-EMITTING ELEMENT

BACKGROUND OF THE INVENTION

Field of the Invention

The aspect of the embodiments relates to image forming apparatuses, and in particular, relates to an image forming apparatus including a detecting unit that detects a density detection image for toner density correction and a position detection image for image forming position correction.

Description of the Related Art

An image forming apparatus, such as a laser printer, may experience fluctuations in density or printing position due to the influence of, for example, a use environment. To correct the fluctuations in density or printing position, some image forming apparatuses perform a process for density correction control or printing position correction control. For example, density detection patch images are formed with different densities on an intermediate transfer belt. A sensor detects light reflected from the patch images or the intermediate transfer belt. The detected light can be used to correct density characteristics of an image forming apparatus. The density characteristics are associated with maximum density values of cyan (C), magenta (M), yellow (Y), and black (Bk) and halftone gradation representation. Furthermore, for example, position detection patch images are formed on the intermediate transfer belt. The sensor detects light reflected from the patch images or the intermediate transfer belt. The detected light can be used to correct image forming positions of the colors (C, M, Y, and Bk).

Such optical sensors for density correction and position correction include sensors configured to detect specular reflection light reflected from a detection target. In the use of such an optical sensor detecting specular reflection light, density correction can be controlled based on how much the intensity of specular reflection light from an image bearing member, serving as a detection target, varies depending on the amount of toner of a density detection patch image formed on the image bearing member. However, if the specular reflection light reflected from the image bearing member is mixed with diffused reflection light reflected from the surface of the density detection patch image and the mixed light is detected by the optical sensor, the detected mixed light may affect density detection performance The degree of such an effect in a case where the density detection patch image is a color toner image is typically greater than that in a case where the density detection patch image is a black toner image.

FIG. 5 is a graph illustrating the amounts of light obtained by detecting density detection patch images formed on an image bearing member through an optical sensor. The graph shows the amount (received light amount) of specular reflection light received by the optical sensor plotted against the amount of toner, or toner density, of the density detection patch image. FIG. 5 demonstrates that the received light amount of specular reflection light decreases with increasing toner density and the received light amount of specular reflection light from a color toner patch image decreases at a lower rate than that from a black toner patch image. The reason may be as follows. Since diffused reflection light reflected from the surface of each density patch image is mixed with specular reflection light and the mixed light is received by a light-receiving element, the received light amount associated with the color toner patch image is larger than that associated with the black toner patch image.

For example, Japanese Patent Laid-Open No. 6-250480 discloses a toner adhesion measuring device including a first light-receiving unit configured to selectively receive the same kind of polarized light as polarized light emitted from a light-emitting unit to toner and reflected from the toner and a second light-receiving unit configured to selectively receive a different kind of polarized light from that emitted from the light-emitting unit. Toner adhesion information is obtained based on the difference between signal outputs of the first and second light-receiving units. In such a configuration, the intensity of light reflected from the surface of the toner can be measured separately from the intensity of light that has passed through the toner and been reflected.

However, in addition to detection of specular reflection light mixed with diffused reflection light, for example, deviation of mounted positions of light-emitting elements from ideal positions or change over time may make it difficult to irradiate a detection target with a sufficient amount of light. In other words, detection accuracy may decrease depending on the ratio between the emitted light amounts of multiple light-emitting elements.

SUMMARY OF THE INVENTION

An apparatus includes a photosensitive member on which an electrostatic latent image is formed, a developing unit that develops the electrostatic latent image on the photosensitive member as an image by using toner, an image bearing member to which the image is transferred, a detecting unit including a plurality of light-emitting elements that emit light toward the image bearing member and a light-receiving element that receives light reflected from a detection target, and a control unit that adjusts an image forming condition. The control unit adjusts a light-emission ratio between the light-emitting elements based on a difference between a reflected light amount at a first position on the image bearing member and a reflected light amount at a second position.

Further features of the disclosure will become apparent from the following description of exemplary embodiments with reference to the attached drawings.

DESCRIPTION OF THE EMBODIMENTS

Exemplary embodiments of the disclosure will be described below with reference to the drawings. The following embodiments are not intended to limit the disclosure described in the appended claims. All of the combinations of features described in the embodiments are not necessary for solving issues in accordance with an embodiment of the disclosure.

First Embodiment

Explanation of Image Forming Apparatus

Figure 1:
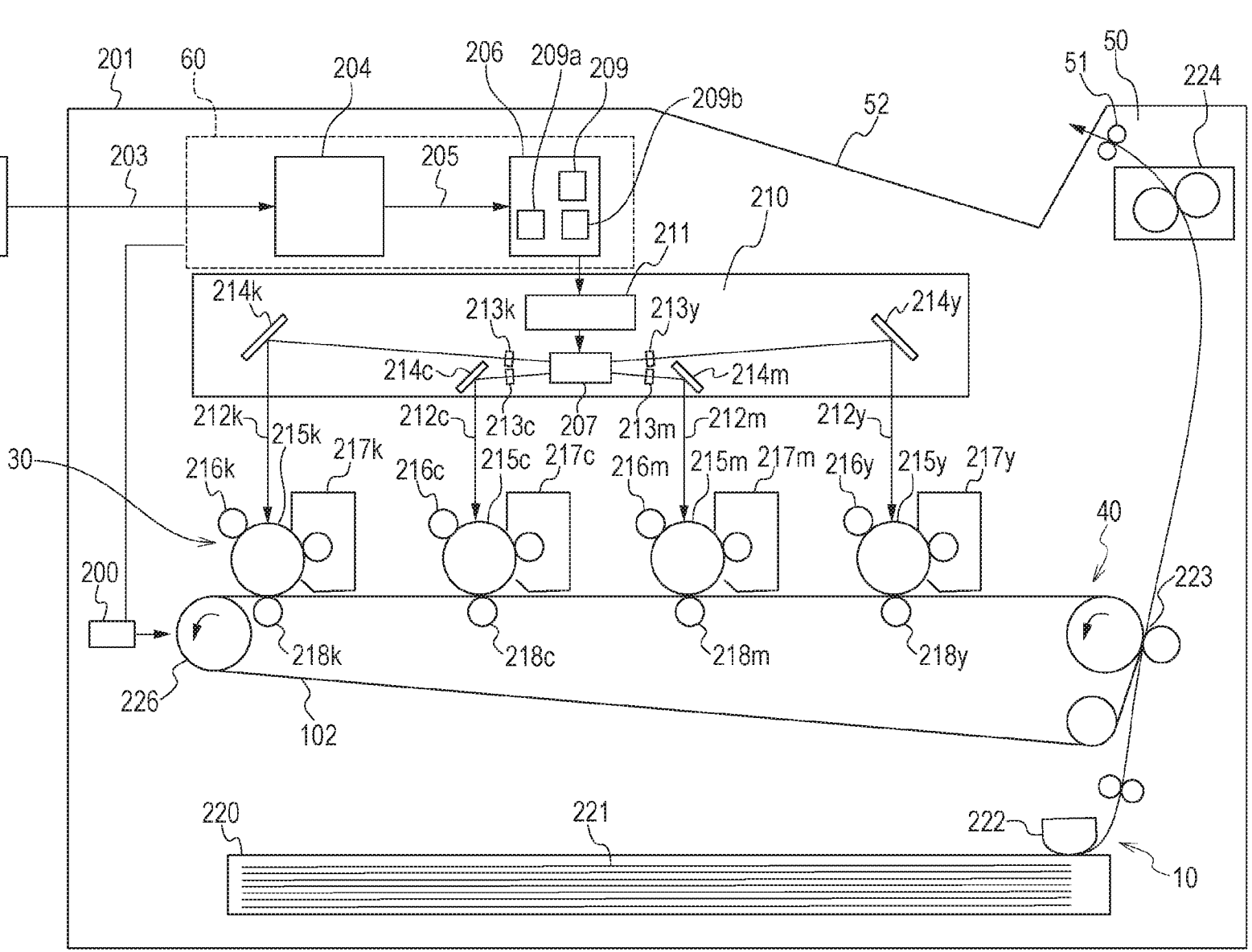
FIG. 1 is a schematic diagram of an exemplary configuration of a laser printer.

FIG. 1 is a schematic diagram of an exemplary configuration of a laser printer 201, serving as an image forming apparatus according to a first embodiment. Examples of the image forming apparatus include an electrophotographic laser printer, a copier, and a facsimile. In this embodiment, an in-line laser printer including an intermediate transfer belt 102 will be described as an example.

The laser printer 201 forms a color image by superposing images of four colors (Y, M, C, and Bk). In the following description, components for Y, M, C, and Bk are designated by reference signs with characters y, m, c, and k, respectively. The characters added to the reference signs may be omitted unless the colors particularly are to be specified.

A sheet feed unit 10 contains a stack of recording media 221, such as paper sheets, and sends the recording media 221 to a transfer unit 40. The sheet feed unit 10 includes a sheet feed cassette 220 containing the stack of recording media 221 and a feed roller 222 feeding the recording media 221 in the sheet feed cassette 220 one by one to the transfer unit 40.

An exposing section 210 applies light to a charged photosensitive drum 215, serving as a photosensitive member. The photosensitive drum 215 is exposed to light applied by the exposing section 210, so that an electrostatic latent image is formed on the photosensitive drum 215. The exposing section 210 includes a laser diode 211, serving as a light source, and a rotating polygon mirror 207 for scanning light emitted from the laser diode 211. Light reflected by the rotating polygon mirror 207 is focused by a lens 213 and is then reflected by a mirror 214, thus forming an image on the photosensitive drum 215. The laser diode 211 is driven based on a video signal 205 generated by an image generation unit 204. In the embodiment, the laser printer 201, which is a color laser printer, includes lenses 213*y*, 213*m*, 213*c*, and 213*k* and mirrors 214*y*, 214*m*, 214*c*, and 214*k* for the respective colors (Y, M, C, and Bk).

For light from the laser diode 211, light beams 212*y*, 212*m*, 212*c*, and 212*k* for the respective colors are reflected by the rotating polygon mirror 207 and then reach the lenses 213*y*, 213*m*, 213*c*, and 213*k*, respectively. The light beams 212*y*, 212*m*, 212*c*, and 212*k* are reflected by the respective mirrors 214*y*, 214*m*, 214*c*, and 214*k*, thus forming images on the surfaces of photosensitive drums 215*y*, 215*m*, 215*c*, and 215*k* for the respective colors.

An image forming unit 30 applies light to the charged photosensitive drums 215 to form electrostatic latent images, applies toner to the electrostatic latent images to form toner images on the photosensitive drums 215, and primarily transfers the toner images onto the intermediate transfer belt 102. The image forming unit 30 includes the exposing section 210, the photosensitive drums 215, charging sections 216, developing sections 217, and transfer rollers 218. In the laser printer 201, the photosensitive drums 215*y*, 215*m*, 215*c*, and 215*k* are arranged in one-to-one correspondence to the respective colors. The charging sections 216*y*, 216*m*, 216*c*, and 216*k*, the developing sections 217*y*, 217*m*, 217*c*, and 217*k*, and the transfer rollers 218*y*, 218*m*, 218*c*, and 218*k* are arranged in one-to-one correspondence to the photosensitive drums 215 for the respective colors.

Each photosensitive drum 215 has a hollow-cylindrical or solid-cylindrical shape and is rotatable. The surface (circumferential surface) of the photosensitive drum 215 is charged by the corresponding charging section 216 and is exposed to light by the exposing section 210, so that an electrostatic latent image is formed on the surface of the photosensitive drum 215. The corresponding developing section 217, serving as a developing unit, applies toner to the surface, on which the electrostatic latent image is formed, of the photosensitive drum 215, so that the electrostatic latent image is formed into a visible toner image on the surface of the photosensitive drum 215. The toner image is transferred from the surface of the photosensitive drum 215 onto the intermediate transfer belt 102, serving as an image bearing member, by the corresponding transfer roller 218. Furthermore, the image forming unit 30 forms, as detection images, a density patch image (density detection image) to be used for density correction control and a position patch image (position detection image) to be used for position correction control.

The transfer unit 40 includes the intermediate transfer belt 102, the transfer rollers 218, and a secondary transfer section 223. The toner images of the respective colors on the photosensitive drums 215 are primarily transferred onto the intermediate transfer belt 102 by the respective transfer rollers 218. The intermediate transfer belt 102, which is an endless belt, is disposed between the photosensitive drums 215 and the transfer rollers 218, and is rotated and driven by a driving roller 226. The transfer rollers 218 apply a primary transfer bias to the toner images, so that the toner images are transferred from the respective photosensitive drums 215 onto the intermediate transfer belt 102. The secondary transfer section 223 applies a secondary transfer bias to the primarily transferred toner images of the respective colors on the intermediate transfer belt 102, so that the toner images are secondarily transferred onto the recording medium 221 fed to the secondary transfer section 223 by the feed roller 222. Specifically, the intermediate transfer belt 102 is come into contact with the recording medium 221 by the secondary transfer section 223 and a driven roller, so that the toner images are secondarily transferred onto the recording medium 221.

A detector 200, serving as a detecting unit, is an optical sensor that optically detects the surface of the intermediate transfer belt 102, serving as a detection target, or a detection image formed on the intermediate transfer belt 102. In the embodiment, the detector 200 is disposed to face toward the driving roller 226, and emits light toward the intermediate transfer belt 102 wound around the driving roller 226. To detect the density or position of a detection image formed on the intermediate transfer belt 102, the detector 200 includes a light-emitting diode (LED) 301, serving as a light source, and a phototransistor (hereinafter, abbreviated to PT) 103, serving as a light-receiving element. The LED 301 emits light toward the surface of the intermediate transfer belt 102. The PT 103 receives light reflected from the intermediate transfer belt 102 or a detection image.

The detector 200 is capable of transmitting a detection result on a density patch image or a position patch image to an image control unit 206. In the laser printer 201 according to the embodiment, the LED 301 includes a plurality of light-emitting elements, indicated at 302 and 303. The arrangement of the light-emitting elements 302 and 303 results in an increase in allowable range of positional deviation caused by, for example, an installation error of the LED 301. In other words, a current through each of the light-emitting elements 302 and 303 is adjusted based on a positional deviation to adjust the amounts of light beams emitted from the respective light-emitting elements. The light-emitting elements 302 and 303 can be used as one light source.

A fixing unit 224 heats and presses the secondarily transferred toner images on the recording medium 221 to fix the toner images to the recording medium 221. The fixing unit 224 includes a pressing roller for pressing the recording medium 221 conveyed from the secondary transfer section 223 and a heater for heating the recording medium 221.

A sheet discharge unit 50 discharges the recording medium 221 subjected to fixing to an output tray 52 disposed outside the laser printer 201. The sheet discharge unit 50 includes discharge rollers 51 arranged downstream of the fixing unit 224 in a conveying direction of the recording media 221 and the output tray 52, in which the discharged recording media 221 are stacked.

A controller 60 controls an operation of the laser printer 201. The controller 60 includes the image generation unit 204 and the image control unit 206. The controller 60, serving as a control unit, also controls an operation of the detector 200. The image control unit 206 includes a central processing unit (CPU) 209 and is connected to the image generation unit 204. The CPU 209 controls an operation of the image forming unit 30 and the operation of the detector 200 in accordance with various programs stored in a read-only memory (ROM) 209*a* while storing characteristic values into a random access memory (RAM) 209*b*, serving as a working area, and using the stored characteristic values. The image generation unit 204 generates a video signal 205 for image formation based on image data 203 sent from an external device 202, and transmits the signal to the image control unit 206. The image control unit 206 is connected to the image forming unit 30. The image control unit 206 causes the image forming unit 30 to form an image based on the video signal 205. Furthermore, the image control unit 206 is connected to the detector 200 and is capable of receiving a detection result from the detector 200.

In the embodiment, the controller 60 performs adjustment based on a detection result of the detector 200 to adjust the amounts of light beams emitted from the light-emitting elements 302 and 303. The controller 60 performs density correction control and position correction control by using the light-emitting elements 302 and 303 subjected to adjustment.

Explanation of Detector 200

Figure 2:
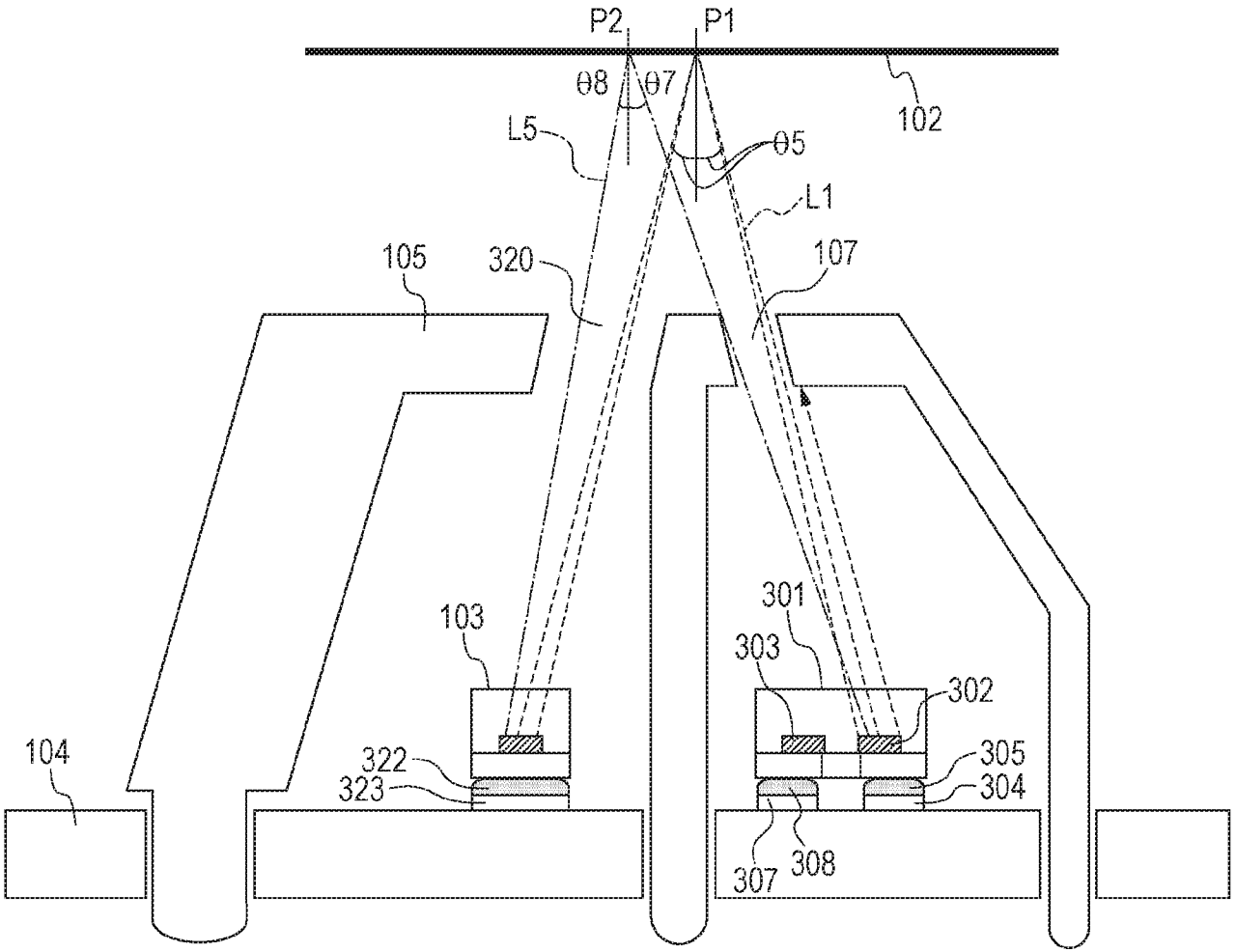
FIG. 2 is a schematic diagram of an exemplary configuration of a detector.

FIG. 2 is a schematic diagram of an exemplary configuration of the detector 200. The detector 200 includes a combination of a circuit board 104 on which the LED 301 including the light-emitting elements 302 and 303 and the PT 103, serving as a light-receiving element, are mounted and a slit holder (outer casing) 105. The circuit board 104 has lands 304 and 307 arranged thereon. The LED 301 is mounted on the lands 304 and 307 with solder 305 and 308 interposed therebetween. The circuit board 104 further has a land 323 disposed thereon. The PT 103 is mounted on the land 323 with solder 322 interposed therebetween.

The slit holder 105 has a light-emitting aperture (first aperture) 107 that restricts the path of light emitted from the light-emitting elements 302 and 303 to the intermediate transfer belt 102. The slit holder 105 further has a light-receiving aperture (second aperture) 320 that restricts the path of light reflected from the intermediate transfer belt 102 or a detection image to the PT 103. Light emitted from the LED 301 mounted on the circuit board 104 passes through the light-emitting aperture 107 such that the path of the light is restricted by the aperture, and is then reflected by the surface of the intermediate transfer belt 102 or a detection image. The reflected light is detected by the PT 103. The LED 301 includes, in one package, the light-emitting elements 302 and 303, which emit infrared rays. The light-emitting elements 302 and 303 are arranged in a direction in which the intermediate transfer belt 102 moves. Specifically, the intermediate transfer belt 102 moves horizontally in FIG. 2.

The light-emitting elements 302 and 303 are infrared light-emitting elements, which emit high-intensity light and are used in remote controllers and light sources for infrared communication. As a package sealing the light-emitting elements 302 and 303, a resin mold package (not illustrated) for, for example, a white LED, is used. A white LED package is a resin mold structure including light sources of different colors. In the detector 200, a package for a white LED or a commercially available multicolor LED chip is used and the light-emitting elements 302 and 303 emitting infrared rays are arranged instead of color light-emitting elements.

In FIG. 2, a light path L1 of light that is emitted from the light-emitting element 302 and serves as a specular-reflection component is indicated by dashed lines. The light emitted from the light-emitting element 302 passes through the light-emitting aperture 107 and impinges at a position (specific position) P1, serving as a detection target, on the intermediate transfer belt 102 at an incident angle of θ5. The light reflected at the position P1 is a specular-reflection component reflected at a reflection angle of θ5. The specular-reflection component passes through the light-receiving aperture 320 and travels to the PT 103. The light path L1 has properties of specular reflection light obtained under conditions where the incident angle of θ5 equals the reflection angle of θ5. If a detection image is formed on the intermediate transfer belt 102, the PT 103 may receive diffused reflection light from the detection image in addition to the specular reflection light from the intermediate transfer belt 102.

A light path L5 is a diffused reflection light path in which light impinges at a position P2 on the intermediate transfer belt 102 at an incident angle of θ7 and is reflected at a reflection angle of θ8 and is received by the PT 103. The light traveling along the light path L5 is diffused reflection light obtained under conditions where the incident angle differs from the reflection angle, and can reach the PT 103. For the amount of light received by the PT 103, the difference between the amount of specular reflection light and the amount of diffused reflection light is to be large as much as possible so that detection images formed on the intermediate transfer belt 102 can be distinguished.

Therefore, the light-emitting aperture 107 can have a diameter that is small enough to reduce a diffused reflection light (scattered light) component, such as light traveling along the light path L5. If the diameter of such an aperture was too small, however, a slight deviation of the mounted position of a light-emitting element would cause light that reaches a detection target position to decrease in amount or cause light to fail to reach the detection target position. In the embodiment, the difference between the amount of specular reflection light and the amount of diffused reflection light can be properly maintained by increasing the amount of light emitted from either the light-emitting element 302 or 303 that provides a larger specular-reflection component than the other light-emitting element.

The light-receiving aperture 320 may be large enough to shield external stray light (disturbance light). The light-receiving aperture 320 may have a larger diameter than the light-emitting aperture 107. It is assumed in the embodiment that a specular-reflection component is a light component reflected by the surface of a base layer of the intermediate transfer belt 102 and a diffused-reflection component is a light component reflected by a detection image on the surface of the intermediate transfer belt 102.

Light Amount Adjustment for Light-Emitting Elements 302 and 303

Figure 3A:
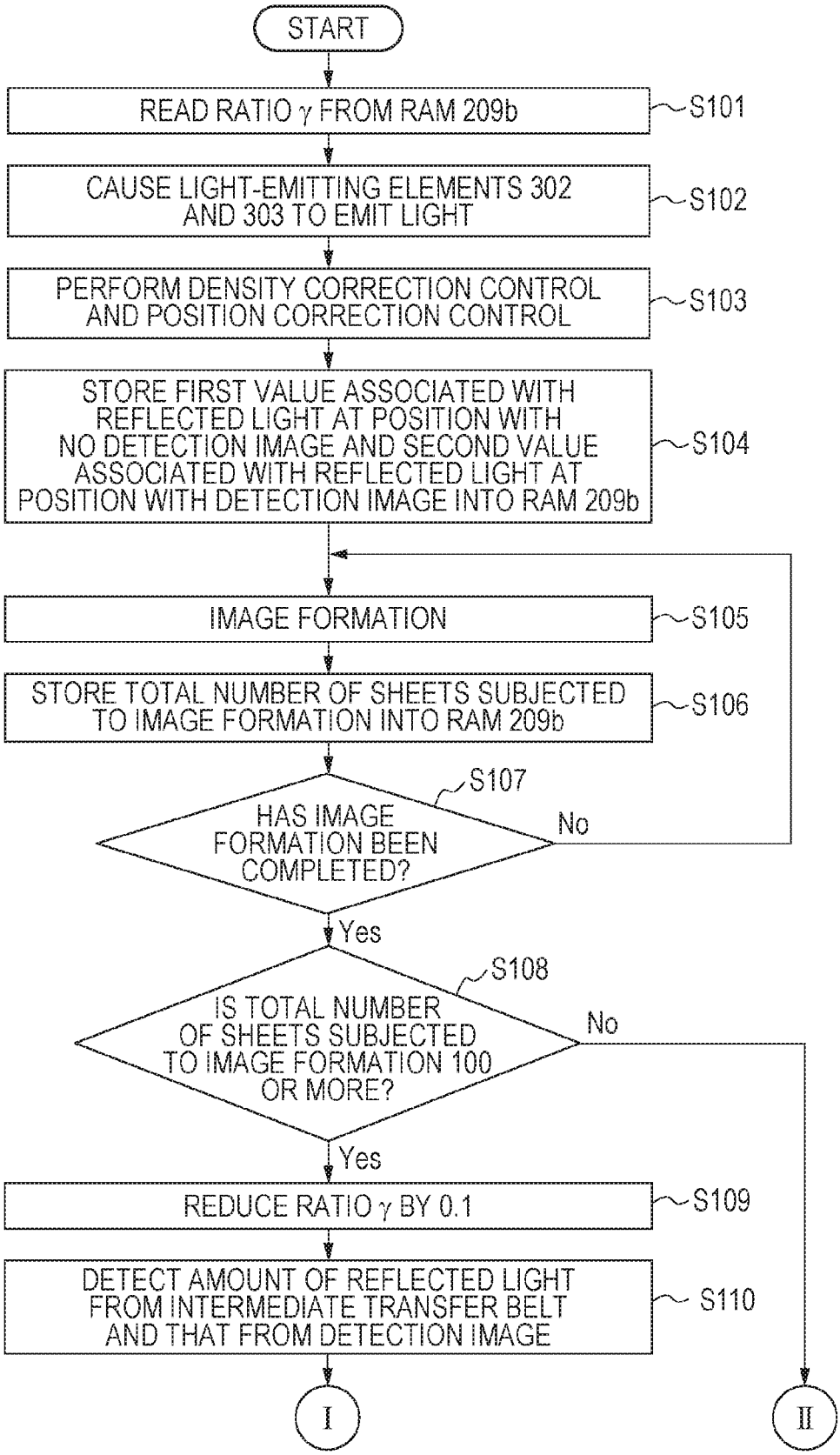
FIGS. 3A and 3B illustrate a flowchart of a light amount adjustment process for light-emitting elements.
Figure 3B:
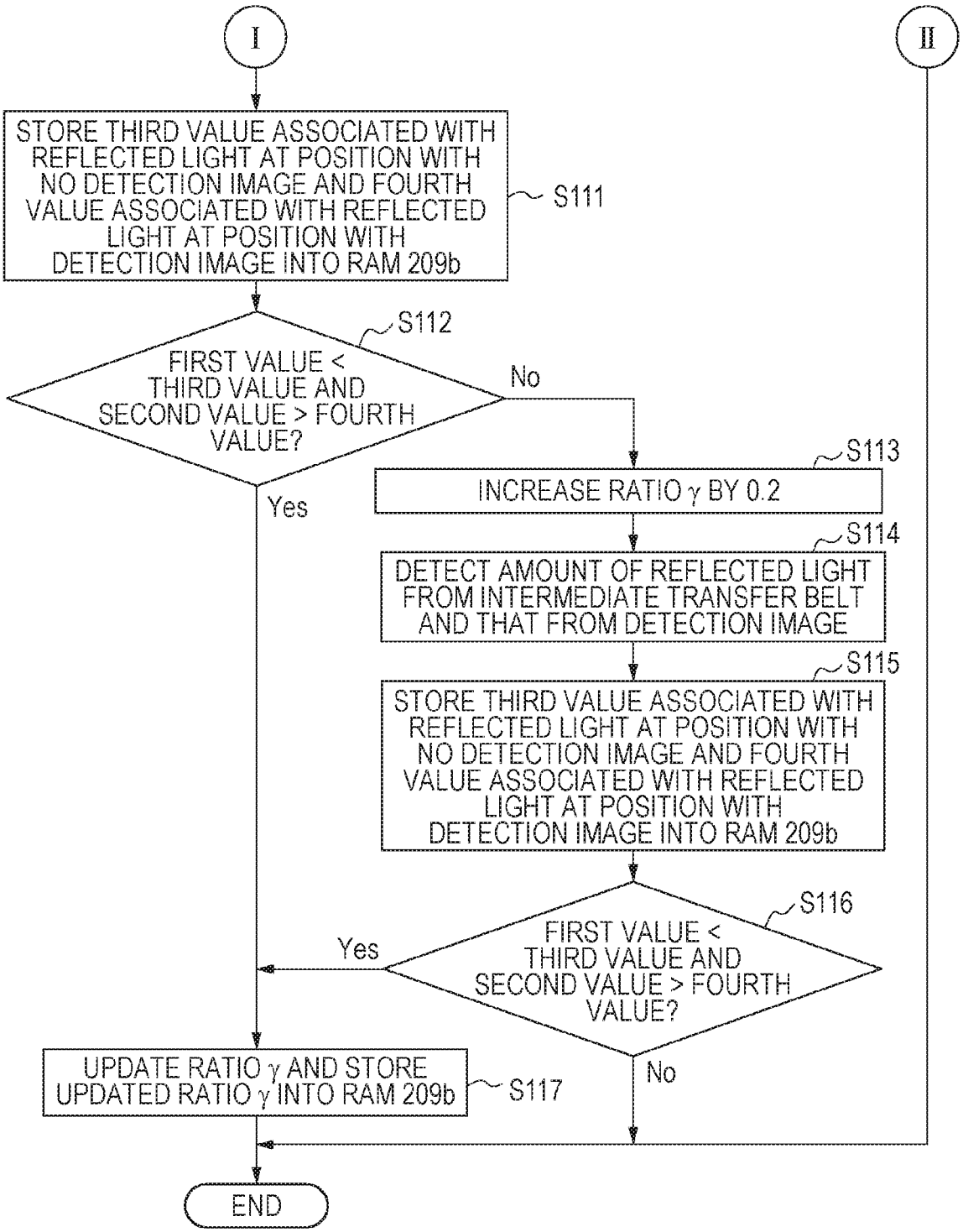

FIGS. 3A and 3B illustrate a flowchart of a light amount adjustment process for the light-emitting elements 302 and 303 in the embodiment. Although light amount adjustment for the two light-emitting elements 302 and 303 will be described as an example, the number of light-emitting elements may be two or more.

In S101, the controller 60 reads data that indicates the ratio γ between currents to flow through the light-emitting elements 302 and 303 and that is stored in the RAM 209*b*. For example, it is assumed herein that the ratio γ is the ratio of a current through the light-emitting element 302 to a current through the light-emitting element 303. Specifically, increasing the ratio γ means adjusting the currents such that the amount of light emitted from the light-emitting element 302 is larger than that from the light-emitting element 303. Reducing the ratio γ means adjusting the currents such that the amount of light emitted from the light-emitting element 302 is smaller than that from the light-emitting element 303.

For example, the initial value of the ratio γin an initial state where printing has not yet been performed, such as upon power-on, is set to 1. The initial value may not be used. If data indicating the ratio is not stored in the RAM 209*b* in S101 or the ratio is equal to 1, light-emission ratio correction for the multiple light-emitting elements that is performed in S109 to S117, which will be described later, can be performed in S101. Specifically, as long as such correction is performed in S101, the light-emitting elements 302 and 303 can emit light at a light-emission ratio adjusted based on the mounted positions of the light-emitting elements, for example, if the mounted positions are deviated from ideal positions.

In S102, the controller 60 supplies the currents to the light-emitting elements 302 and 303 at the ratio γ so that the light-emitting elements 302 and 303 each emit light stably. It takes some time before the amounts of light beams emitted from the light-emitting elements 302 and 303 stabilize after the currents are supplied to and flow through the light-emitting elements. The timing at which the currents are supplied to the light-emitting elements 302 and 303 may be determined at any time. The currents are simultaneously supplied to the light-emitting elements 302 and 303 such that the light-emitting elements simultaneously start to emit light. Alternatively, the currents are supplied to the light-emitting elements 302 and 303 such that the timing of current supply to the light-emitting element 302 overlaps that to the light-emitting element 303. Such control results in less downtime than in a case where the light-emitting elements are turned on at different times and the amounts of light beams emitted from the respective light-emitting elements are individually stabilized.

A precondition for density correction control or position correction control will now be described. Light emitted from the light-emitting elements 302 and 303 and reflected by the intermediate transfer belt 102 is detected in the following manner. The reflected light from the intermediate transfer belt 102 is received, or detected, by the PT 103 and the amount of received light, or received light amount, is converted into a voltage. Assuming that an upper limit input to an AD terminal of the CPU 209 is 3.3 V, adjustment is performed so that the voltage obtained by converting the received light amount is 3.3 V or less. This adjustment enables an increase or decrease in reflected light amount, which varies depending on a change in amount of toner of a patch formed on the intermediate transfer belt 102, to be detected as a change in input to the AD terminal. Density correction control or position correction control can be performed based on such an input or a change in input.

In S103, the controller 60 performs density correction control and position correction control. For density correction control, while an image forming condition (density) is changed, patch images having different densities are formed on the intermediate transfer belt 102. The PT 103 detects light beams reflected from the patch images having the different densities. High-pressure conditions for, for example, the charging sections 216, and image forming conditions including the amount of light emitted from the laser diode 211 are adjusted based on detection results, so that the density of an image and halftone gradation characteristics can be properly adjusted.

In density correction control, as the difference between the amount of light reflected at a position where a density patch image is formed and the amount of light reflected from the intermediate transfer belt 102, serving as a position where no density patch image is formed, is larger, the density patch image is detected with higher accuracy. A small difference between such reflected light amounts results in a reduction in range of sensor outputs obtained from a reflected light amount at a position with no density patch image to a reflected light amount at a position with a density patch image having a maximum density. In other words, a reduction in range of outputs results in an increase in influence of noise fluctuations on the AD terminal, so that sufficient detection accuracy may fail to be obtained. It is, therefore, important to properly maintain the difference between reflected light amounts.

For printing position correction control, position patch images of the respective colors (Y, M, C, and Bk) are formed on the intermediate transfer belt 102. The PT 103 detects light beams reflected from the position patch images. The amount of misregistration is obtained based on the timing of detection of the position patch image of each color and the timing of detection of a corresponding position patch image at an ideal position. Image forming conditions including the timing of writing with each of the laser beams 212*y*, 212*m*, 212*c*, and 212*k* are adjusted based on the amount of misregistration, so that the misregistration can be properly corrected.

In position correction control, as the difference between the amount of light reflected at a position where a position patch image is formed and the amount of light reflected from the intermediate transfer belt 102, serving as a position where no position patch image is formed, is larger, the position patch image is detected with higher accuracy. A small difference between such reflected light amounts makes it difficult to determine whether the intermediate transfer belt 102 is detected or the position patch image is detected. In other words, this results in a reduction in slew rate to be detected at the AD terminal when the position patch image is detected, so that sufficient detection timing accuracy may fail to be obtained. It is, therefore, important to properly maintain the difference between reflected light amounts.

In S104, the controller 60 stores, as a first value, a received light amount of the PT 103 based on reflected light from the intermediate transfer belt 102, serving as a position (first position) where no detection image is formed, into the RAM 209*b*. Furthermore, the controller 60 stores, as a second value, a received light amount of the PT 103 based on reflected light at a position (second position) where a detection image having a 100% density, also called a solid image, is formed into the RAM 209*b*. As described above, as the first value is larger and the second value is smaller, or as the difference between an output value associated with the base layer of the intermediate transfer belt 102 and that associated with the detection image is larger, density correction control and position correction control can be performed with higher accuracy. To achieve high detection accuracy, the amounts of light beams emitted from the multiple light-emitting elements are adjusted. Thus, the above-described difference can be properly maintained.

One of factors causing fluctuations in the above-described difference is that a reduction in amount of toner in, for example, a developer container, may lead to a lower density of a formed detection image than intended. A lower density of a detection image results in a reduction in difference. For this reason, the amounts of light beams emitted from the multiple light-emitting elements are adjusted as will be described later, thereby properly adjusting the difference.

In S105, the controller 60 performs normal image formation. In S106, the controller 60 stores data indicating the number of sheets subjected to image formation into the RAM 209*b*. In S107, the controller 60 determines whether image formation has been completed. If image formation has not been completed, the process returns to S105. If image formation has been completed, the process proceeds to S108.

In S108, the controller 60 determines whether the total number of sheets subjected to image formation stored as data in the RAM 209*b* is 100 or more. If the number of sheets is 100 or more, the process proceeds to S109, where light-emission ratio correction is performed to correct the ratio γ of the current through the light-emitting element 302 to the current through the light-emitting element 303. The term "ratio γ" as used herein represents the relationship between the amounts of light beams emitted from the light-emitting elements 302 and 303. Light-emission ratio correction is performed in such a manner that, for example, whether to cause the light-emitting element 302 to emit a larger amount of light than the light-emitting element 303, whether to cause the light-emitting element 303 to emit a larger amount of light than the light-emitting element 302, or how much difference should be provided between the amounts of light beams emitted from the light-emitting elements is determined and the relationship between the amounts of light beams is adjusted.

If the total number of sheets subjected to image formation is not 100 or more, light-emission ratio correction is not performed. The data indicating the total number of sheets subjected to image formation is stored in the RAM 209*b*. The total number of sheets subjected to image formation increases each time image formation is performed. Although 100 is used as an exemplary threshold, the threshold may be any other value. The number of sheets subjected to image formation, serving as a threshold, may be appropriately set based on the amount of toner in each developer container or the lifetimes of the multiple light-emitting elements.

In S109 and the following steps, light-emission ratio correction in the embodiment is performed. In S109, the controller 60 reduces the ratio γ of the current through the light-emitting element 302 to the current through the light-emitting element 303 by 0.1. Reducing the ratio γ is adjustment for reducing the amount of light emitted from the light-emitting element 302, or increasing the amount of light emitted from the light-emitting element 303. In S110, the controller 60 detects a received light amount of the PT 103 based on reflected light from the intermediate transfer belt 102, serving as a position where no detection image is formed. Furthermore, the controller 60 detects a received light amount of the PT 103 based on reflected light at a position where a detection image having a 100% density, also called a solid image, is formed.

In S111, the controller 60 stores, as a third value, the detected received light amount of the PT 103 based on the reflected light from the intermediate transfer belt 102, or the reflected light at the position where no detection image is formed, into the RAM 209*b*. Furthermore, the controller 60 stores, as a fourth value, the detected received light amount of the PT 103 based on the reflected light at the position where the detection image having a 100% density, or the solid image, is formed into the RAM 209*b*.

In S112, the controller 60 compares the first value with the third value to determine whether the third value is greater than the first value. Furthermore, the controller 60 compares the second value with the fourth value to determine whether the fourth value is less than the second value. If these two conditions are satisfied, light amount adjustment for increasing the difference can be achieved. The process proceeds to S117. If the two conditions are not satisfied, the process proceeds to S113. Although the process proceeds to S117 as soon as the two conditions are satisfied in this exemplary adjustment, the process may be performed in any other manner. For example, the ratio γ may be further reduced to a value at which the difference is not increased, and after that, the process may proceed to S117. Such adjustment will be described in detail in a second embodiment, which will be described later.

In S113, the controller 60 increases the ratio γ of the current through the light-emitting element 302 to the current through the light-emitting element 303 by 0.2. Increasing the ratio γ is adjustment for increasing the amount of light emitted from the light-emitting element 302, or reducing the amount of light emitted from the light-emitting element 303. The reason why the ratio γ is increased by 0.2 is that a reduction in the ratio γ by 0.1 in S109 is taken into account and the ratio γ is increased by only 0.1. Although this adjustment is performed in such a manner that the ratio γ is reduced and is then increased, the ratio may be changed in a reverse manner.

In S114, the controller 60 detects a received light amount of the PT 103 based on reflected light from the intermediate transfer belt 102, serving as a position where no detection image is formed. Furthermore, the controller 60 detects a received light amount of the PT 103 based on reflected light at a position where a detection image having a 100% density, also called a solid image, is formed.

In S115, the controller 60 stores, as a third value, the detected received light amount of the PT 103 based on the reflected light from the intermediate transfer belt 102, or the reflected light at the position where no detection image is formed, into the RAM 209*b*. Furthermore, the controller 60 stores, as a fourth value, the detected received light amount of the PT 103 based on the reflected light at the position where the detection image having a 100% density, or the solid image, is formed into the RAM 209*b*.

In S116, the controller 60 compares the first value with the third value to determine whether the third value is greater than the first value. Furthermore, the controller 60 compares the second value with the fourth value to determine whether the fourth value is less than the second value. If these two conditions are satisfied, light amount adjustment for increasing the difference can be achieved. The process proceeds to S117. If the two conditions are not satisfied, the process terminates without changing the ratio γ. Although the process proceeds to S117 as soon as the two conditions are satisfied in this exemplary adjustment, the process may be performed in any other manner. For example, the ratio γ may be further increased to a value at which the difference is not increased, and after that, the process may proceed to S117. Such adjustment will be described in detail in the second embodiment, which will be described later. In S117, the controller 60 updates the ratio γ between the light-emitting elements 302 and 303 and stores the updated ratio γ into the RAM 209*b*.

The above-described adjustment to determine the light-emission ratio between the light-emitting elements 302 and 303 reduces or eliminates a reduction in detection accuracy, so that density correction control and position correction control can be performed accurately. In the embodiment, light beams reflected at the following positions are detected as examples to calculate the difference. Specifically, light reflected from the intermediate transfer belt 102, serving as a position (first position) where no detection image is formed, and light reflected at a position (second position) where a detection image having a 100% density, also called a solid image, is formed are detected. These light beams reflected at the two positions are suitable for comparison because the largest difference can be obtained. However, any other positions may be used to calculate the difference. For example, light reflected at a position (first position) where a detection image having a 10% density (first density) is formed and light reflected at a position (second position) where a detection image having a 90% density (second density) is formed may be detected and the difference therebetween may be obtained. Depending on calculation accuracy, a position with no detection image and a position with a detection image, or alternatively, two positions with detection images having different densities can be used as detection targets and the light-emission ratio between the multiple light-emitting elements can be adjusted using these detection targets.

Second Embodiment

In the above-described first embodiment, adjustment is performed by increasing or decreasing the ratio γ by 0.1. Reducing the range of change of the ratio γ reduces the time it takes to perform light-emission ratio correction. In the second embodiment, a method of making the range of change of the ratio γ wider than that in the first embodiment to obtain a more proper ratio γ will be described. In the second embodiment, redundant description of the configuration of the image forming apparatus and the same components as those in the foregoing first embodiment is avoided.

Figure 4A:
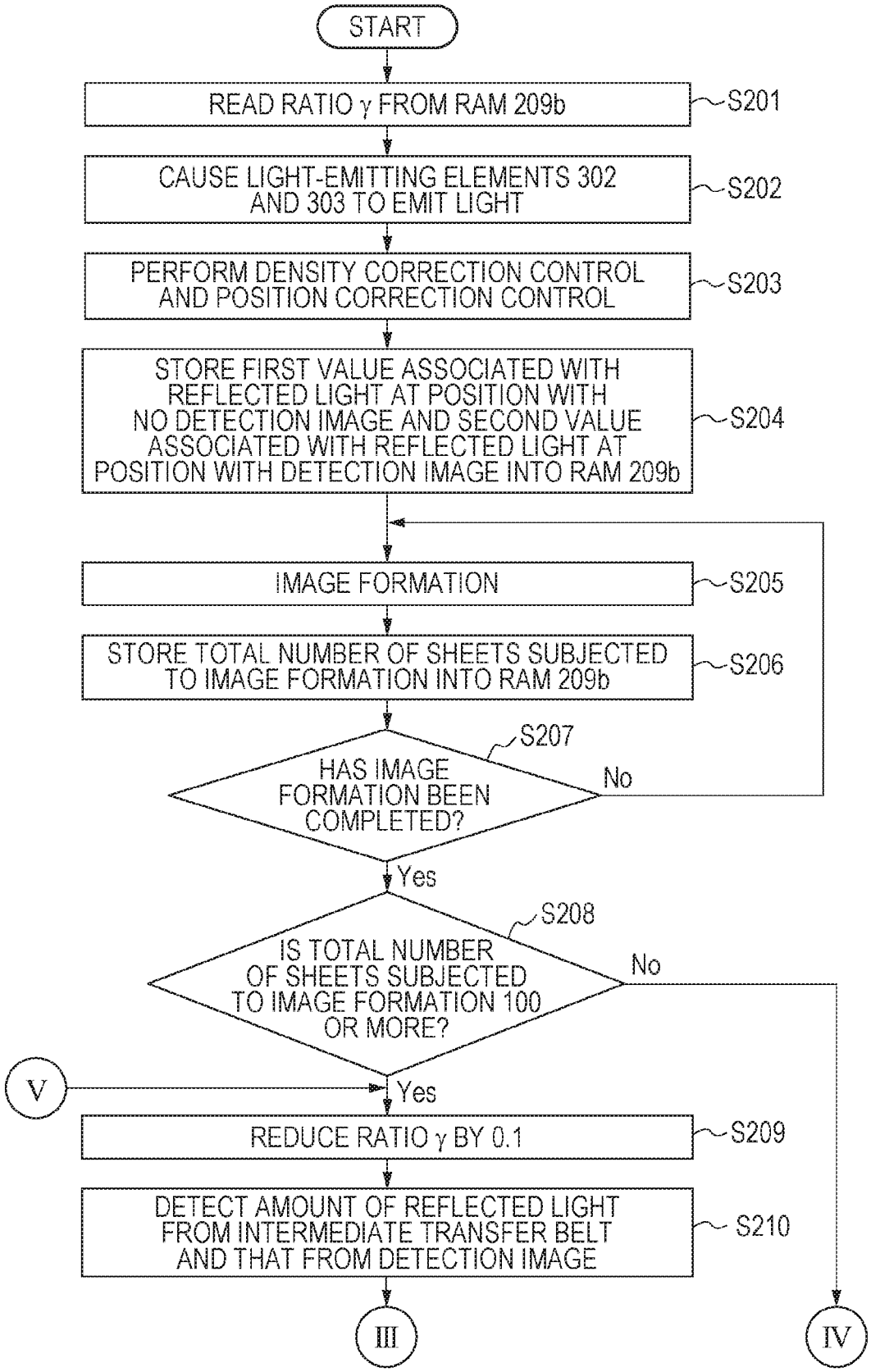
FIGS. 4A and 4B illustrate a flowchart of a light amount adjustment process for the light-emitting elements.
Figure 4B:
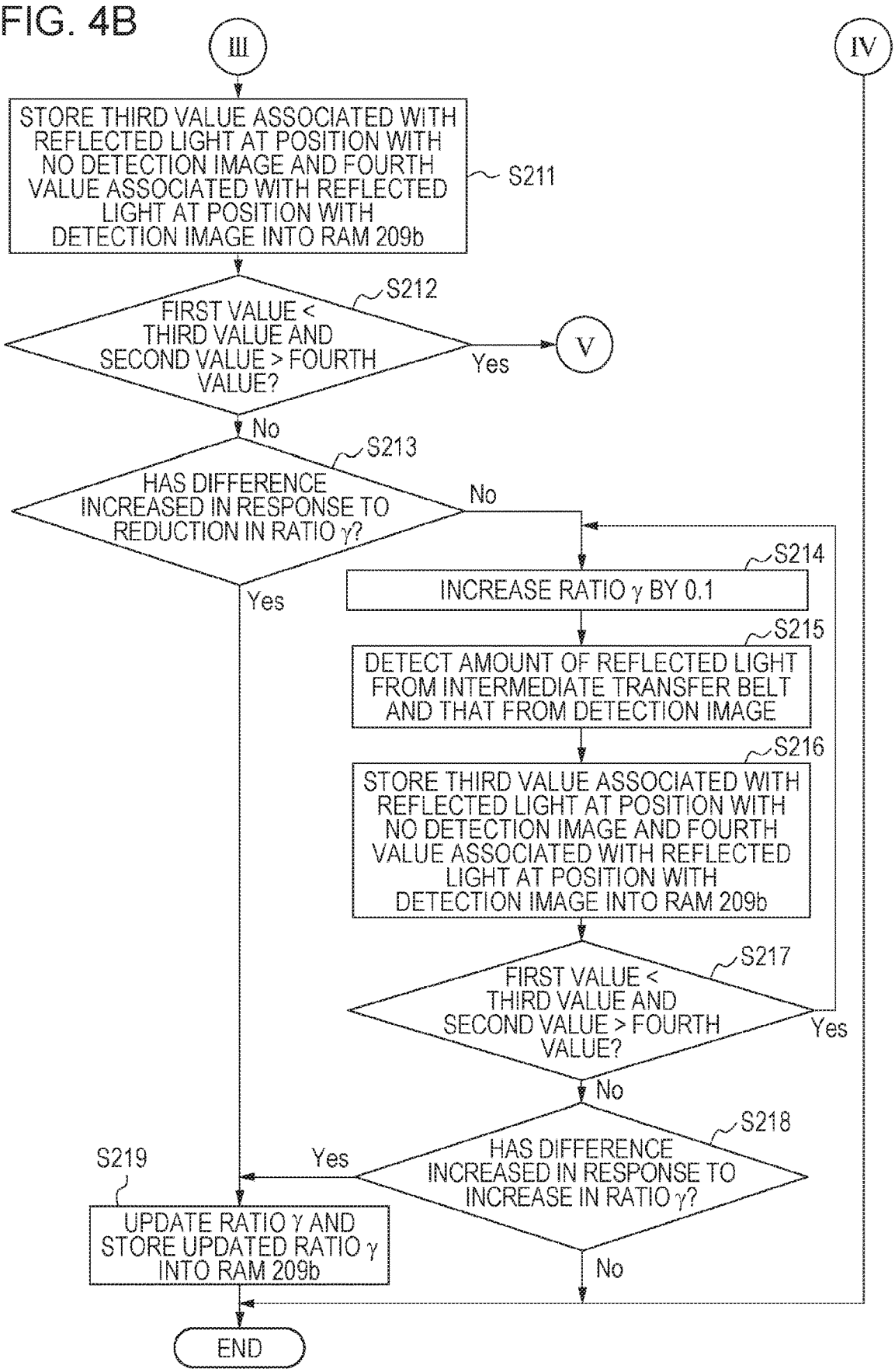
Figure 5:
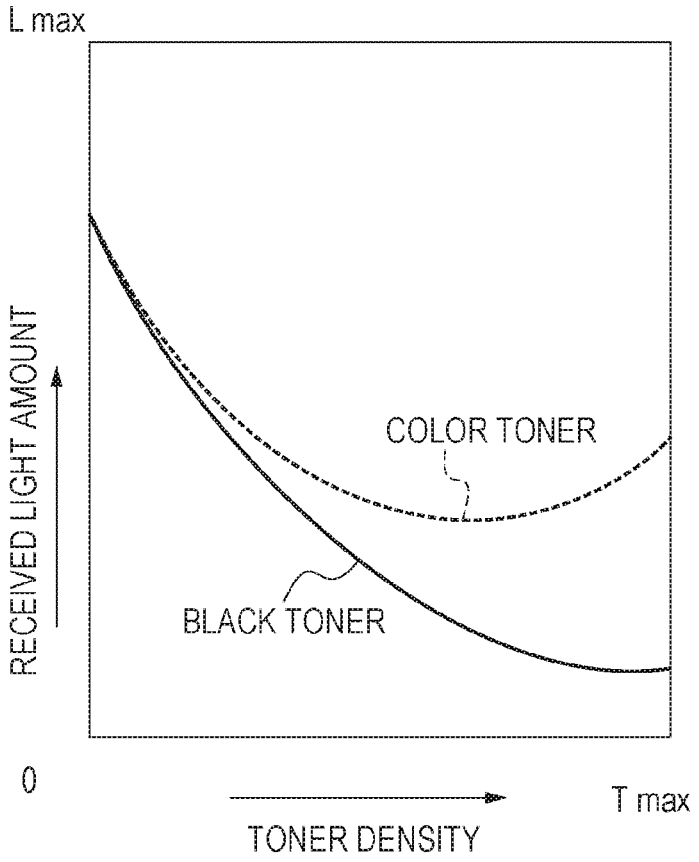
FIG. 5 PRIOR ART
FIG. 5 is a graph illustrating the amounts of light obtained by detecting density detection patch images through an optical sensor.

FIGS. 4A and 4B illustrate a flowchart of a light amount adjustment process for the light-emitting elements 302 and 303 in this embodiment. Although light amount adjustment for the two light-emitting elements 302 and 303 will be described as an example, the number of light-emitting elements may be two or more. Steps in S201 to S208 in FIG. 4A are the same as those in S101 to S108 in the foregoing first embodiment, and redundant description of these steps is avoided.

In S209 and the following steps, light-emission ratio correction in the embodiment is performed. In S209, the controller 60 reduces the ratio γ of a current through the light-emitting element 302 to a current through the light-emitting element 303 by 0.1. Reducing the ratio γ is adjustment for reducing the amount of light emitted from the light-emitting element 302, or increasing the amount of light emitted from the light-emitting element 303. In S210, the controller 60 detects a received light amount of the PT 103 based on reflected light from the intermediate transfer belt 102, serving as a position where no detection image is formed. Furthermore, the controller 60 detects a received light amount of the PT 103 based on reflected light at a position where a detection image having a 100% density, also called a solid image, is formed.

In S211, the controller 60 stores, as a third value, the detected received light amount of the PT 103 based on the reflected light from the intermediate transfer belt 102, or the reflected light at the position where no detection image is formed, into the RAM 209*b*. Furthermore, the controller 60 stores, as a fourth value, the detected received light amount of the PT 103 based on the reflected light at the position where the detection image having a 100% density, or the solid image, is formed into the RAM 209*b*.

In S212, the controller 60 compares the first value with the third value to determine whether the third value is greater than the first value. Furthermore, the controller 60 compares the second value with the fourth value to determine whether the fourth value is less than the second value. If the two conditions are satisfied, the process proceeds to S209 to further reduce the ratio γ. Since the process proceeds to S209, steps in S209 to S212 can be repeated until the ratio γ at which the largest difference can be obtained is found. If the two conditions are not satisfied, the process proceeds to S213. In S213, the controller 60 determines whether the difference has increased at least once in response to a reduction in ratio in S209. If the difference has increased, the process proceeds to S219. If the difference has not increased, the process proceeds to S214.

In S214, the controller 60 increases the ratio γ of the current through the light-emitting element 302 to the current through the light-emitting element 303 by 0.1. Increasing the ratio γ is adjustment for increasing the amount of light emitted from the light-emitting element 302, or reducing the amount of light emitted from the light-emitting element 303. Although this adjustment is performed in such a manner that the ratio γ is reduced and is then increased, the ratio may be changed in a reverse manner.

In S215, the controller 60 detects a received light amount of the PT 103 based on reflected light from the intermediate transfer belt 102, serving as a position where no detection image is formed. Furthermore, the controller 60 detects a received light amount of the PT 103 based on reflected light at a position where a detection image having a 100% density, also called a solid image, is formed.

In S216, the controller 60 stores, as a third value, the detected received light amount of the PT 103 based on the reflected light from the intermediate transfer belt 102, or the reflected light at the position where no detection image is formed, into the RAM 209*b*. Furthermore, the controller 60 stores, as a fourth value, the detected received light amount of the PT 103 based on the reflected light at the position where the detection image having a 100% density, or the solid image, is formed into the RAM 209*b*.

In S217, the controller 60 compares the first value with the third value to determine whether the third value is greater than the first value. Furthermore, the controller 60 compares the second value with the fourth value to determine whether the fourth value is less than the second value. If the two conditions are satisfied, the process proceeds to S214 to further increase the ratio γ. Since the process proceeds to S214, steps in S214 to S217 can be repeated until the ratio γ at which the largest difference can be obtained is found. If the two conditions are not satisfied, the process proceeds to S218. In S218, the controller 60 determines whether the difference has increased at least once in response to an increase in ratio in S214. If the difference has increased, the process proceeds to S219. If the difference has not increased, the process terminates. In S219, the controller 60 updates the ratio γ between the light-emitting elements 302 and 303 and stores the updated ratio γ into the RAM 209*b*.

The above-described adjustment to determine the light-emission ratio between the light-emitting elements 302 and 303 reduces or eliminates a reduction in detection accuracy, so that density correction control and position correction control can be performed accurately. In addition, the light-emission ratio correction in the embodiment can be used to more properly adjust the light-emission ratio between the light-emitting elements 302 and 303.

According to the aspect of the embodiments, adjusting the light-emission ratio between multiple light-emitting elements reduces or eliminates a reduction in detection accuracy.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-140607, filed Jul. 26, 2018, which is hereby incorporated by reference herein in its entirety.

What is claimed is:

1. An apparatus comprising:

a photosensitive member on which an electrostatic latent image is formed;

a developing unit that develops the electrostatic latent image as an image by using toner;

an image bearing member to which the image is transferred;

a detecting unit including a plurality of light-emitting elements that emit light toward the image bearing member and a light-receiving element that receives light reflected from a detection target; and a control unit that adjusts an image forming condition, wherein the control unit adjusts a light-emission ratio between the light-emitting elements based on a difference between a reflected light amount at a first position on the image bearing member and a reflected light amount at a second position.

2. The apparatus according to claim 1, wherein the first position is a position where no image is formed on the image bearing member and the second position is a position where an image is formed on the image bearing member.

3. The apparatus according to claim 1, wherein the first position is a position where an image having a first density is formed on the image bearing member and the second position is a position where an image having a second density higher than the first density is formed on the image bearing member.

4. The apparatus according to claim 1, wherein the control unit compares a first difference between the reflected light amounts obtained at a first light-emission ratio with a second difference between the reflected light amounts obtained at a second light-emission ratio to adjust the light-emission ratio between the light-emitting elements.

5. The apparatus according to claim 2, wherein the control unit compares a first difference between the reflected light amounts obtained at a first light-emission ratio with a second difference between the reflected light amounts obtained at a second light-emission ratio different from the first light-emission ratio to adjust the light-emission ratio between the light-emitting elements.

6. The apparatus according to claim 4, wherein when the first difference is larger than the second difference, the control unit causes the light-emitting elements to emit light at the first light-emission ratio, and when the second difference is larger than the first difference, the control unit causes the light-emitting elements to emit light at the second light-emission ratio.

7. The apparatus according to claim 5, wherein when the first difference is larger than the second difference, the control unit causes the light-emitting elements to emit light at the first light-emission ratio, and when the second difference is larger than the first difference, the control unit causes the light-emitting elements to emit light at the second light-emission ratio.

8. The apparatus according to claim 4, wherein the first light-emission ratio allows a first light-emitting element to emit a larger amount of light than a second light-emitting element and the second light-emission ratio allows the second light-emitting element to emit a larger amount of light than the first light-emitting element, and wherein when the first difference is larger than the second difference, the control unit causes the light-emitting elements to emit light at a third light-emission ratio that allows the first light-emitting element to emit a larger amount of light than that at the first light-emission ratio, and when the second difference is larger than the first difference, the control unit causes the light-emitting elements to emit light at a fourth light-emission ratio that allows the second light-emitting element to emit a larger amount of light than that at the second light-emission ratio.

9. The apparatus according to claim 5, wherein the first light-emission ratio allows a first light-emitting element to emit a larger amount of light than a second light-emitting element and the second light-emission ratio allows the second light-emitting element to emit a larger amount of light than the first light-emitting element, and wherein when the first difference is larger than the second difference, the control unit causes the light-emitting elements to emit light at a third light-emission ratio that allows the first light-emitting element to emit a larger amount of light than that at the first light-emission ratio, and when the second difference is larger than the first difference, the control unit causes the light-emitting elements to emit light at a fourth light-emission ratio that allows the second light-emitting element to emit a larger amount of light than that at the second light-emission ratio.

10. The apparatus according to claim 1, wherein the control unit causes a density detection image or a position detection image to be formed as a detection image on the image bearing member, and wherein the detecting unit causes the light-emitting elements to emit light at a light-emission ratio determined by the control unit and causes the light-receiving element to receive light reflected at a position where the detection image is formed.

11. The apparatus according to claim 10, wherein when the density detection image is detected as the detection image, the control unit corrects, as the image forming condition, a density of an image to be formed, and when the position detection image is detected as the detection image, the control unit corrects, as the image forming condition, a position of an image to be formed.

12. The apparatus according to claim 1, wherein the light-emitting elements are arranged in a direction in which the image bearing member moves.

13. The apparatus according to claim 1, wherein the control unit controls the light-emitting elements such that the light-emitting elements simultaneously start to emit light.

14. A method comprising:

forming an electrostatic latent image on a photosensitive member;

developing the electrostatic latent image on the photosensitive member as an image by using toner;

transferring the image to an image bearing member;

emitting light toward the image bearing member by a plurality of light-emitting elements and receiving light reflected from a detection target by a light-receiving element; and adjusting an image forming condition, wherein the adjusting adjusts a light-emission ratio between the light-emitting elements based on a difference between a reflected light amount at a first position on the image bearing member and a reflected light amount at a second position.

15. The method according to claim 14, wherein the first position is a position where no image is formed on the image bearing member and the second position is a position where an image is formed on the image bearing member.

16. The method according to claim 14, wherein the first position is a position where an image having a first density is formed on the image bearing member and the second position is a position where an image having a second density higher than the first density is formed on the image bearing member.

17. The method according to claim 14 further comprising:

comparing a first difference between the reflected light amounts obtained at a first light-emission ratio with a second difference between the reflected light amounts obtained at a second light-emission ratio to adjust the light-emission ratio between the light-emitting elements.

18. The method according to claim 14, forming a density detection image or a position detection image as a detection image on the image bearing member;

emitting light at a light-emission ratio; and receiving light reflected at a position where the detection image is formed.

19. The method according to claim 14, wherein the light-emitting elements are arranged in a direction in which the image bearing member moves.

20. The method according to claim 14, wherein the light-emitting elements is controlled such that the light-emitting elements simultaneously start to emit light.

* * * * *